US009933194B2

(12) United States Patent
Pendlebury et al.

(10) Patent No.: US 9,933,194 B2
(45) Date of Patent: Apr. 3, 2018

(54) CO2 REFRIGERATION SYSTEM

(71) Applicant: Elstat Limited, Preston (GB)

(72) Inventors: Neil Pendlebury, Blackpool (GB); Colin Hull, Fleetwood (GB)

(73) Assignee: ELSTAT LIMITED, Preston (GB)

( * ) Notice: Subject to any disclaimer, the term of this patent is extended or adjusted under 35 U.S.C. 154(b) by 237 days.

(21) Appl. No.: 14/649,552

(22) PCT Filed: Dec. 5, 2013

(86) PCT No.: PCT/GB2013/053221
§ 371 (c)(1),
(2) Date: Jun. 4, 2015

(87) PCT Pub. No.: WO2014/087168
PCT Pub. Date: Jun. 12, 2014

(65) Prior Publication Data

US 2015/0316305 A1 Nov. 5, 2015

(30) Foreign Application Priority Data

Dec. 7, 2012 (GB) ..... 1222091.9

(51) Int. Cl.
*F25B 49/02* (2006.01)
*F25B 9/00* (2006.01)
*F25B 49/00* (2006.01)

(52) U.S. Cl.
CPC ..... *F25B 49/022* (2013.01); *F25B 9/006* (2013.01); *F25B 49/005* (2013.01); (Continued)

(58) Field of Classification Search
CPC ..... F25B 9/006; F25B 9/008; F25B 49/005; F25B 49/022; F25B 2309/061; F25B 2600/02; F25B 2700/2102
See application file for complete search history.

(56) References Cited

U.S. PATENT DOCUMENTS 4,381,549 A 4/1983 Stamp et al.
5,528,908 A 6/1996 Bahel et al.
(Continued)

FOREIGN PATENT DOCUMENTS

DE 10-2008-037784 2/2010
EP 1 442 906 8/2004
(Continued)

OTHER PUBLICATIONS

WIPO, International Search Report for PCT/GB2013/053221, dated Apr. 14, 2014.
(Continued)

*Primary Examiner* — Marc Norman
(74) *Attorney, Agent, or Firm* — Siritzky Law, PLLC

(57) ABSTRACT

A $CO_2$ refrigeration system (1) includes: a compressor (3), a gas cooler (5), a temperature sensor (17) and an electronic control system (13), the electronic control system including a processor device (15) arranged to control operation of the compressor (3) according to input signals received from the temperature sensor (17), wherein the temperature sensor (17) is positioned to read an output temperature of the gas cooler. A method for controlling a compressor (3) in a $CO_2$ refrigeration system (1) is also disclosed.

33 Claims, 7 Drawing Sheets

(52) U.S. Cl.
CPC ..... *F25B 2309/061* (2013.01); *F25B 2600/02* (2013.01); *F25B 2700/2102* (2013.01)

(56) References Cited

U.S. PATENT DOCUMENTS

| | | | | |
|---|---|---|---|---|
| 6,182,456 | B1 * | 2/2001 | Yamaguchi | F25B 9/008 62/204 |
| 2002/0050143 | A1 * | 5/2002 | Watanabe | F25B 9/008 62/204 |
| 2002/0170299 | A1 | 11/2002 | Jayanth et al. | |
| 2004/0237549 | A1 | 12/2004 | Okawara et al. | |
| 2005/0198980 | A1 * | 9/2005 | Cowell | B60H 1/3205 62/226 |
| 2006/0236708 | A1 * | 10/2006 | Mizuno | B60H 1/3219 62/228.3 |
| 2007/0227165 | A1 * | 10/2007 | Ohta | F25B 9/008 62/196.1 |
| 2010/0175400 | A1 | 7/2010 | Kasahara | |
| 2012/0073316 | A1 | 3/2012 | Hegar et al. | |
| 2012/0227427 | A1 | 9/2012 | Liu et al. | |
| 2015/0219379 | A1 * | 8/2015 | Sun | F25B 49/022 62/115 |

FOREIGN PATENT DOCUMENTS

| | | |
|---|---|---|
| EP | 2 175 212 | 4/2010 |
| EP | 2 434 232 | 3/2012 |
| JP | H02238275 A | 9/1990 |
| JP | 2003-074995 | 3/2003 |
| WO | WO 2008/010988 | 1/2008 |
| WO | WO 2011/049778 | 4/2011 |

OTHER PUBLICATIONS

U.K. Intellectual Property Office (UK IPO), Search Report in GB1320977.0, completed Jun. 24, 2014.

* cited by examiner

CO2 REFRIGERATION SYSTEM

This application is the National Phase of International Application PCT/GB2013/053221, filed Dec. 5, 2013, which designated the U.S., and that International Application was published under PCT Article 21(2) in English. The entire contents of PCT/GB2013/053221 are hereby fully incorporated herein by reference for all purposes.

The present invention relates to a Carbon Dioxide ($CO_2$) refrigeration system and a method for monitoring and controlling pressure within such a system.

A $CO_2$ refrigeration system is a refrigeration system that includes carbon dioxide as (or in) its refrigerant. A typical $CO_2$ refrigeration system includes a compressor, a heat exchanger, an evaporator and a microcontroller for controlling operation of the compressor, and other system functions, to carry out the processes of evaporation, compression, condensation, and expansion of $CO_2$ refrigerant.

Use of $CO_2$ as a refrigerant began in the mid-nineteenth century and steadily increased, reaching a peak in the 1920s. Its use declined with the introduction of chlorofluorocarbons (CFCs) that operated at much lower pressures. Use of $CO_2$ continued, but chiefly in cascade systems for industrial and process applications. Recently, strong interest has been shown in $CO_2$ as a refrigerant by vending machine manufacturers. There are also possibilities for other light commercial refrigeration applications, as well as for residential air conditioning.

In a $CO_2$ refrigeration system, refrigerant pressure remains constant in the evaporator while heat gain during the evaporation process increases. When the compressor is run, the $CO_2$ pressure rises sharply and steadily as it is compressed. During the condensing process, heat absorbed during evaporation—and the heat added during compression—is rejected out of the system. In addition, the quality of the refrigerant changes until it is 100 percent liquid. A further cooling of the liquid often occurs so that the refrigerant is sub-cooled when leaving the condenser. There is no change in pressure or temperature during the phase change.

The final process in the cycle is expansion and a corresponding drop in refrigerant pressure. The pressure drop occurs as the refrigerant passes through a metering device (expansion valve or capillary tube). During the expansion process, refrigerant condition changes from sub-cooled liquid to a mixture of liquid and vapour.

Unlike the subcritical condensing process, where temperature stays constant, temperature decreases during the entire trans-critical heat rejection process. There is no condensation in a trans-critical cycle and the process is referred to as gas cooling.

A system based on the trans-critical $CO_2$ cycle uses a high pressure expansion valve (HPEV). Rather than controlling refrigerant metering from the low-pressure side of the system, modulation control comes from the high side of the system. A mechanical HPEV will control refrigerant injection into the evaporator by opening and closing based on the increase or decrease in gas cooler pressure.

The function of the compressor in a trans-critical application is the same as in a subcritical one. The compressor creates refrigerant flow, increasing discharge pressure and therefore raising refrigerant temperature to a level high enough that heat absorbed in the evaporator will be rejected in the condenser or gas cooler.

The major challenges in $CO_2$ refrigeration involve the relatively high working pressures: 70+ bar (7,000 kPa).

In $CO_2$ refrigeration systems, circumstances can arise that cause the pressure within the system to exceed normal operating pressures, for example if a blockage occurs in the gas cooler, the gas cooler fan fails, or if there is overcharging of the system. This is undesirable and can result in damage system components. Furthermore, regulatory requirements often require $CO_2$ refrigeration systems to include a safety device because of the high operating pressures.

Known systems currently address these issues in at least one of two ways: 1) by including a pressure relief switch that is arranged to switch the compressor off when the pressure within the system reaches a threshold value; and 2) including a "bursting disc", which is arranged to break in the event that the pressure within the system exceeds a threshold value.

In the refrigeration circuit, the pressure relief switch is located in the high pressure side, typically close to the output side of the compressor, and in series therewith. The pressure switch is arranged to open (i.e. to switch off the compressor) when the pressure inside the system reaches approximately 80% of the maximum system operating pressure. FIG. 1 shows a typical prior art wiring arrangement wherein the pressure relief switch A is located in the live input B between the compressor C and the microcontroller D, thus when the switch A is opened power is cut to the compressor C, which causes the pressure in the system to decrease. When the pressure drops below a predetermined threshold, the switch automatically closes and the compressor C restarts. However with known refrigeration systems the pressure switch A can oscillate the refrigeration system as the pressure rises and falls, which is undesirable. This reduces the efficiency of the refrigeration system and can cause the compressor C to fail more quickly.

The bursting disc is a single use device that protects refrigeration system components from over pressurisation by rupturing when the refrigeration system pressure exceeds a predetermined value. However when the disc bursts the refrigerant and lubricant within the system is vented to atmosphere. This can cause the compressor to fail and therefore many manufacturers are reluctant to use this method in isolation.

Attempts to predict pressure using temperature (i.e. PV=nRT) have historically been unsuccessful. Typically, a temperature probe is placed on the hottest part of the system, as the gas enters the first stage of cooling in the primary heat exchanger or gas cooler. Such positioning seems intuitive. However, the temperature reading at this point in the system is not a reliable measure of pressure. Indeed, it may predict a pressure that can be 20-50 bar out of step with the actual pressure. The reasons for the discrepancy range from the energy coming from the compressor through to the unique characteristics of $CO_2$ under pressure, namely the trans-critical behaviour of $CO_2$ when it exists as a fluid with gas like (space filling) characteristics.

As a result, the industry has had no other option than to fit a pressure sensor to record pressure within the system and protect the system from over-pressurising. Pressure sensors are mechanical devices that add moving parts and the ability to fail to a system that is working under pressure. Therefore, such a sensor is far from ideal for use in such a situation.

Accordingly the present invention seeks to provide apparatus that mitigates at least one of the aforementioned problems, or at least provides an alternative to existing systems. In particular, the invention seeks to provide a more effective and efficient way of measuring and controlling the pressure inside a $CO_2$ refrigeration system, while reducing the possibility of the system oscillating, thereby improving the safety and/or stability of the system.

According to one aspect of the invention there is provided a $CO_2$ refrigeration system, including: a compressor, a gas cooler, a temperature sensor, the electronic control system including a processor device arranged to control operation of the compressor according to input signals received from the temperature sensor, wherein the temperature sensor is positioned to read an output temperature of the gas cooler.

Expressed in another way, the input signals received by the processor device from the temperature sensor are the temperature readings of the refrigerant at the exit of the gas cooler.

Contrary to previous experience of using temperature to provide an indication of gas cooler pressure, the inventors have discovered that if the $CO_2$ temperature is measured at the exit or output of the gas cooler, this temperature reading is accurately indicative of the pressure within the refrigeration system. Indeed, changes in temperature at the output of the gas cooler have been found to be proportional to changes in pressure in the refrigeration system.

Thus, the present invention makes use of this discovery to control pressure in the refrigeration system by monitoring the temperature with the temperature sensor and controlling operation of the compressor according to the output signals (temperature readings) from the temperature sensor. This provides improved control of the refrigeration system. It also improves the safety of the system since the system is able to be controlled to operate within pre-set safety limits, thereby preventing the need to discharge the refrigerant to atmosphere.

The invention is applicable to many different types of $CO_2$ refrigeration systems, for example those used in shops, vending machines, air conditioning units, etc.

Measuring the output temperature of the gas cooler may be achieved, for example by measuring the temperature of the refrigerant directly as it exits the gas cooler. Additionally, or alternatively, the temperature may be measured by, for example mounting the temperature sensor on at least one of a gas cooler wall and an adjacent conduit.

The compressor is used to compress the refrigerant to a high pressure. The refrigerant flows from the compressor to the gas cooler. The refrigerant flows from the gas cooler to a heat exchanger and then to an evaporator via an expansion device. The expansion device expands the refrigerant. The refrigerant flows from the evaporator back to the compressor via the heat exchanger. At the compressor, the refrigerant is compressed again.

Advantageously a first temperature value corresponding to an upper threshold temperature may be stored in memory in the processor device and the processor device includes instructions to compare the measured gas cooler output temperature with the first temperature value. When the processor device determines that the measured temperature is greater than or equal to the first temperature value, the processor device deactivates the compressor, for example by cutting power to the compressor.

Typically, the first temperature value is an upper threshold temperature which corresponds to an upper or maximum operating pressure. If the processor device determines that the measured temperature is greater than or equal to the upper threshold temperature (first temperature value), this is indicative that the pressure within the refrigeration system has reached or exceeded its normal upper operating limit and thus the system is at risk of leaking or exploding Deactivating the compressor enables the pressure in the system to reduce.

Advantageously the processor device may be arranged to generate a gas cooler alarm signal each time the measured temperature is determined to be greater than or equal to the upper threshold temperature (first temperature value). The processor device may be arranged to shut down the refrigeration system if the number of gas cooler alarms exceeds a predetermined value within a predetermined time period.

A second temperature value, such as an offset temperature value, may be stored in memory in the processor device.

The offset temperature value is the magnitude of the temperature difference between the upper threshold temperature value and a lower threshold temperature value. That is, the lower threshold temperature value is equal to the first temperature value minus the offset temperature value. The offset temperature value typically represents the required drop in temperature that takes place at the gas cooler, when starting at the upper threshold temperature value, before the lower threshold temperature value is reached.

Advantageously the lower threshold temperature value may be stored in memory in the processor device.

Advantageously the processor device may be arranged to compare the measured gas cooler output temperature with the lower threshold temperature value. When the processor device determines that the measured temperature is less than or equal to the lower threshold temperature value, the processor device is arranged to initiate an extended rest period for the compressor. The processor device uses the lower threshold temperature value as a trigger for initiating the extended rest period for the compressor. Advantageously the extended rest period may be a fixed period for the refrigeration system. This ensures that there is always a minimum period for which the compressor is deactivated. Alternatively, the time of the extended rest period may be dictated by the temperature of the refrigerant as it exits the gas cooler. Once the temperature drops to or below a certain level, the extended rest period is then ended by the processor device. This analogue functionality helps to avoid oscillation of the system.

The processor device is arranged to activate the compressor when the extended rest period has ended.

Advantageously the extended rest period is set to last for at least 3 minutes, preferably at least 5 minutes, more preferably at least 8 minutes and more preferably still at least 10 minutes. The period is selected to ensure that there is sufficient rest time to prevent oscillation in the refrigeration system.

Advantageously the processor device has an internal clock and the extended rest period may be timed by the internal clock. Additionally, or alternatively, the control system may include a separate timing device.

Advantageously the lower threshold temperature value may be determined by subtracting the offset temperature value from the upper threshold temperature value.

Advantageously the offset temperature value is at least 5° C., preferably at least 8° C., and more preferably at least 10° C., and more preferably still at least 12° C. The offset temperature value contributes to the total length of time for which the compressor is switched off.

Advantageously the offset temperature value is less than 25° C., preferably less than 20° C., and more preferably still less than 15° C.

Advantageously the temperature sensor may be connected to an auxiliary input of the processor device. This enables the processor device to receive input signals from the temperature sensor.

Advantageously the system may include a pressure sensitive device such as a pressure operated switch device, purely as a back-up or auxiliary measurement to the temperature sensor. The pressure sensitive device may be connected to an auxiliary input of the processor device. This enables the processor device to receive input signals from the pressure sensitive device.

Advantageously the processor device includes an interface that is arranged to enable the user to set at least one of the following parameters: the upper threshold temperature value, the offset temperature value, the lower threshold temperature value, and the length of the extended rest period for the compressor. It will be appreciated that since the lower threshold temperature value is equal to the upper threshold temperature value minus the offset temperature value, the interface may be set up such that any two of the three parameters may be set by the user. However, in preferred embodiments, the user is able to set the upper threshold temperature value and the offset temperature value, with the lower threshold temperature value being calculated accordingly.

Advantageously the refrigeration system may include a rupturing device, such as a bursting disc, that ruptures when the operating pressure within the refrigeration system reaches a rupture pressure, wherein the processor device is arranged to control operation of the compressor to maintain the refrigeration system operating pressure at a value that is less than the rupture pressure.

Advantageously the refrigeration system may include high pressure pipes for connecting system components. The pipes are arranged to withstand the maximum pressure that the refrigeration system can produce. This ensures that even if the system is over pressurised, refrigerant will not inadvertently leak from the pipes.

According to another aspect of the invention there is provided a method for controlling a compressor in a $CO_2$ refrigeration system, said $CO_2$ refrigeration system having a compressor, a gas cooler, a temperature sensor and an electronic control system including a processor device, wherein the method comprises measuring $CO_2$ refrigerant temperature at the output of the gas cooler with the temperature sensor and using the processor device to control operation of the compressor according to input signals received by the processor device from the temperature sensor.

The method may include comparing the measured temperature of the gas cooler output with an upper threshold temperature value stored in memory in the processor device. The method may include automatically deactivating the compressor when the processor device determines that the measured temperature is greater than or equal to the upper threshold temperature.

The method may include the processor device generating a gas cooler alarm signal each time the measured temperature is determined to be greater than or equal to the first temperature value.

The method may include the processor device shutting down the refrigeration system if the number of gas cooler alarms exceeds a predetermined value within a predetermined time period.

The method may include storing an offset value in memory means.

The method may include calculating a lower threshold temperature value. The lower temperature threshold value may be calculated by subtracting the offset value from the upper threshold temperature value.

The method may include storing the lower threshold temperature value.

The method may include comparing the measured temperature of the gas cooler output with the lower threshold temperature value.

The method may include automatically initiating an extended rest period for the compressor when the processor device determines that the measured temperature is less than or equal to the lower threshold temperature value.

The method may include activating the compressor when the extended rest period has ended or the temperature of the refrigerant at the output of the gas cooler has reached or dropped below a pre-set temperature.

The method may include an extended rest period lasting for at least 3 minutes, preferably at least 5 minutes, more preferably at least 8 minutes and more preferably still at least 10 minutes.

The method may include the difference between the first and second stored temperature values being at least 5° C., preferably at least 8° C., and more preferably at least 10° C., and more preferably still at least 12° C.

The method may include the difference between the first and second stored temperature values being less than 25° C., preferably less than 20° C., and more preferably still less than 15° C.

The refrigeration system may include a rupturing device that ruptures when the operating pressure within the refrigeration system reaches a pre-set or predetermined rupture pressure and the method may include the processor device controlling operation of the compressor to maintain the refrigeration system operating pressure at a value that is less than the rupture pressure.

According to another aspect of the invention there is provided a refrigeration system, including: a compressor, a gas cooler, a temperature sensor and an electronic control system, the electronic control system including a processor device arranged to control operation of the compressor according to input signals received from the temperature sensor, wherein the temperature sensor is positioned to read an output temperature of the gas cooler.

According to another aspect of the invention there is provided a method for controlling a compressor in a $CO_2$ refrigeration system, said $CO_2$ refrigeration system having a compressor, a gas cooler, a temperature sensor and an electronic control system including a processor device, wherein the method comprises measuring $CO_2$ refrigerant temperature at the output of the gas cooler with the temperature sensor and using the processor device to control operation of the compressor according to input signals received by the processor device from the temperature sensor.

Advantageously this aspect of the invention is applicable to refrigeration systems that use a different refrigerant from $CO_2$. The features of the $CO_2$ refrigeration system mentioned above are also applicable to this aspect of the invention.

An embodiment of the present invention will now be described, by way of example only, with reference to the accompanying drawings in which.

Figure 1:
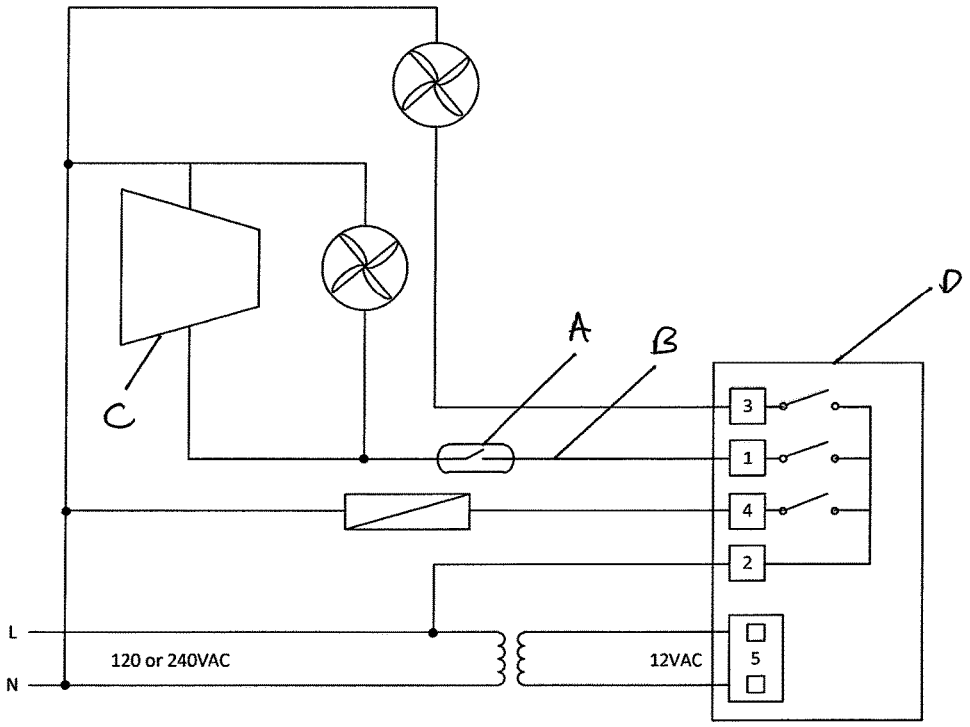
Fig. 1 (Prior Art)
FIG. 1 is an electrical circuit diagram for a prior art $CO_2$ refrigeration system.
Figure 2:
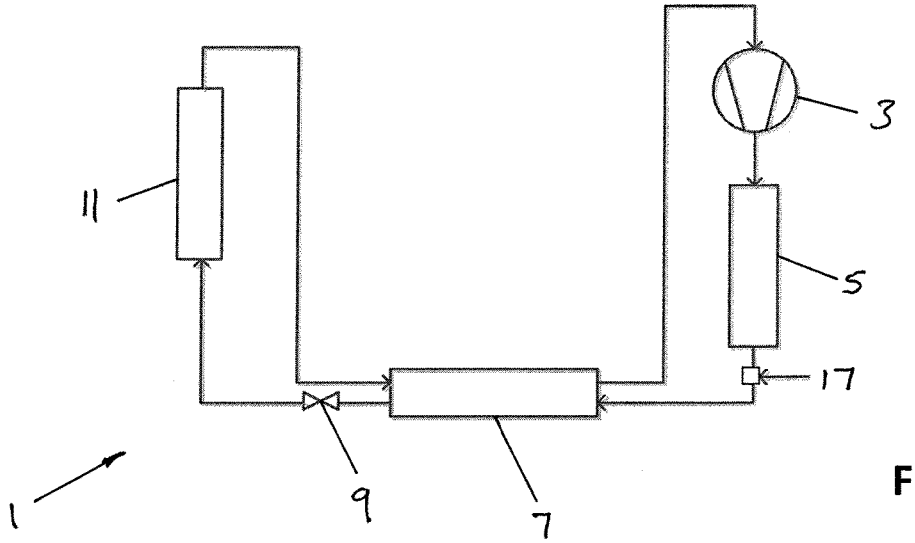
FIG. 2 is a diagrammatic view of a $CO_2$ refrigeration system in accordance with a first embodiment of the invention.
Figure 3:
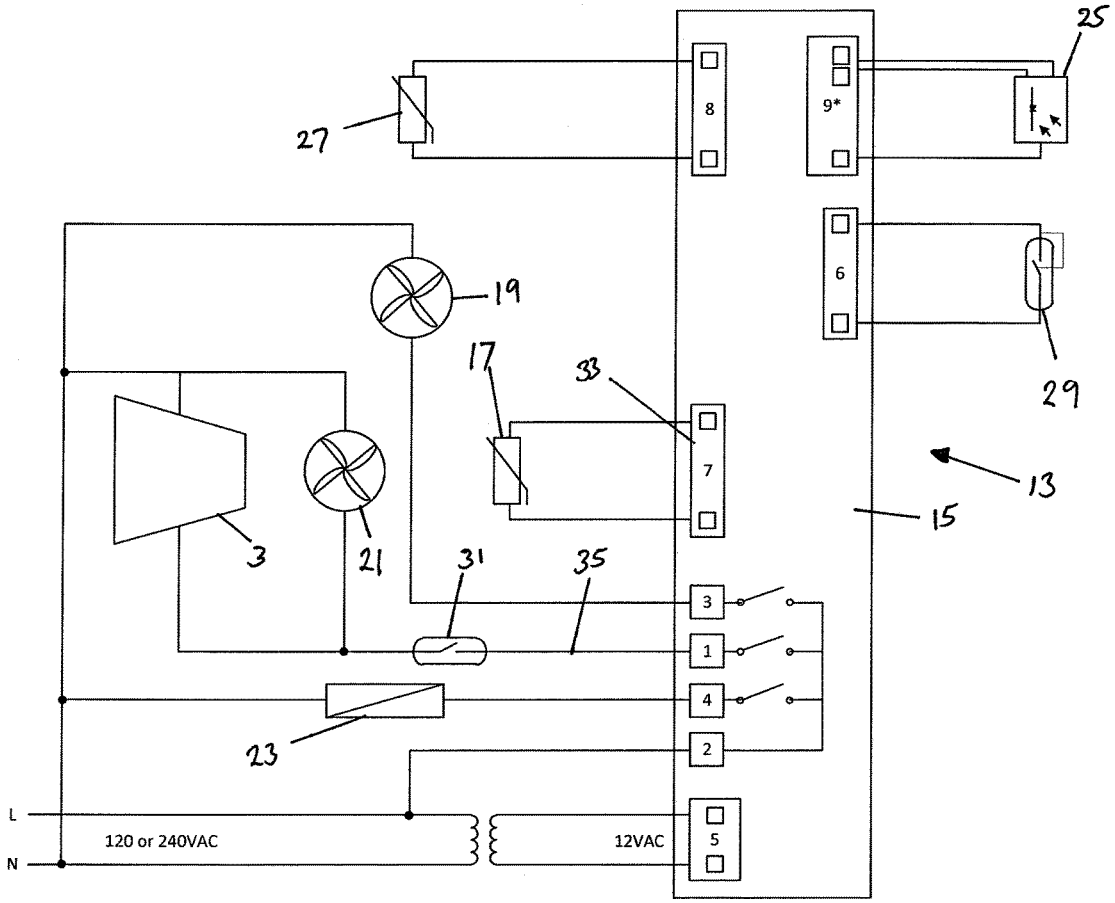
FIG. 3 is a wiring diagram for the $CO_2$ refrigeration system of FIG. 2.

FIGS. 2 and 3 show a first embodiment of a $CO_2$ refrigeration system 1 in accordance with the invention, in diagrammatic form. The refrigeration system 1 includes a compressor 3, gas cooler 5, heat exchanger 7, expansion valve 9 and evaporator 11, connected together in a refrigeration circuit, and a control system 13.

The control system 13 includes a microcontroller 15 and a temperature sensor 17. The microcontroller 15 controls operation of the compressor 3, and optionally controls operation of at least one of the following components: an evaporator fan 19; a condenser fan 21, and system lights 23. Optionally, the microcontroller 15 may receive inputs from other parts of the refrigeration system such as a microRMD 25; an appliance sensor 27 such as a thermistor for measuring temperature in a refrigerator cooling compartment; and a door opening switch 29.

The microcontroller 15 controls operation of the compressor according to inputs received from the appliance sensor 27, for example to maintain the cooling compartment within a desired temperature range.

The temperature sensor 17 is electrically connected to an auxiliary input 33 of the microcontroller 15. The microcontroller 15 uses input signals received from the temperature sensor 17 to control operation of the compressor 3 to ensure that the refrigeration system operates within predetermined operating conditions, for example conditions that are considered to be safe for the application.

The temperature sensor 17 is physically located such that it measures the temperature of the $CO_2$ refrigerant $T_{GC}$ as it exits the gas cooler 5. The inventors have discovered that there is a relationship between the temperature of the $CO_2$ refrigerant as it exits the gas cooler 5 and the pressure in the refrigeration system 1. This is illustrated in the graphs shown in FIGS. 4 to 7.

Figure 4:
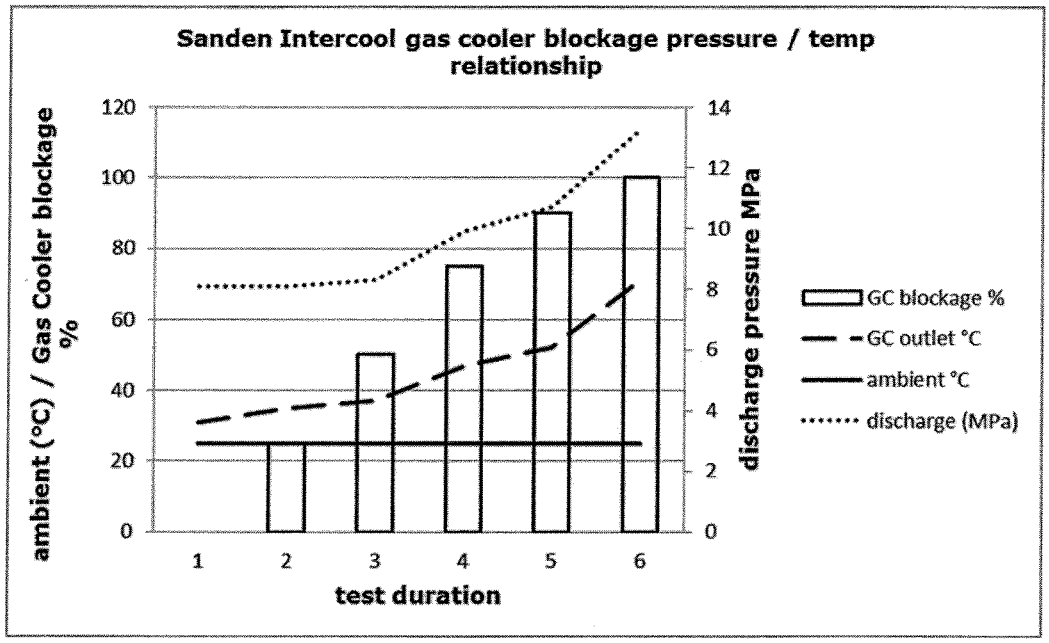
FIGS. 4 and 5 are graphs showing the relationship between pressure and the output temperature of a gas cooler, with varying amounts of gas cooler blockage.

FIG. 4 shows the relationship between the system discharge pressure (discharging from the compressor 3) and gas cooler output temperature for a Sanden Intercool™ gas cooler, at constant ambient temperature, as the percentage of blockage in the gas cooler increases. The refrigeration system used a 0.27 Kg charge of $CO_2$. The inventors discovered that, as the gas cooler becomes increasingly blocked (thereby simulating a possible system failure), the temperature at the output of the gas cooler substantially tracks discharge pressure. That is, there is a substantially proportional relationship between the gas cooler output temperature and the refrigeration system pressure with increasing blockage of the gas cooler.

Figure 5:
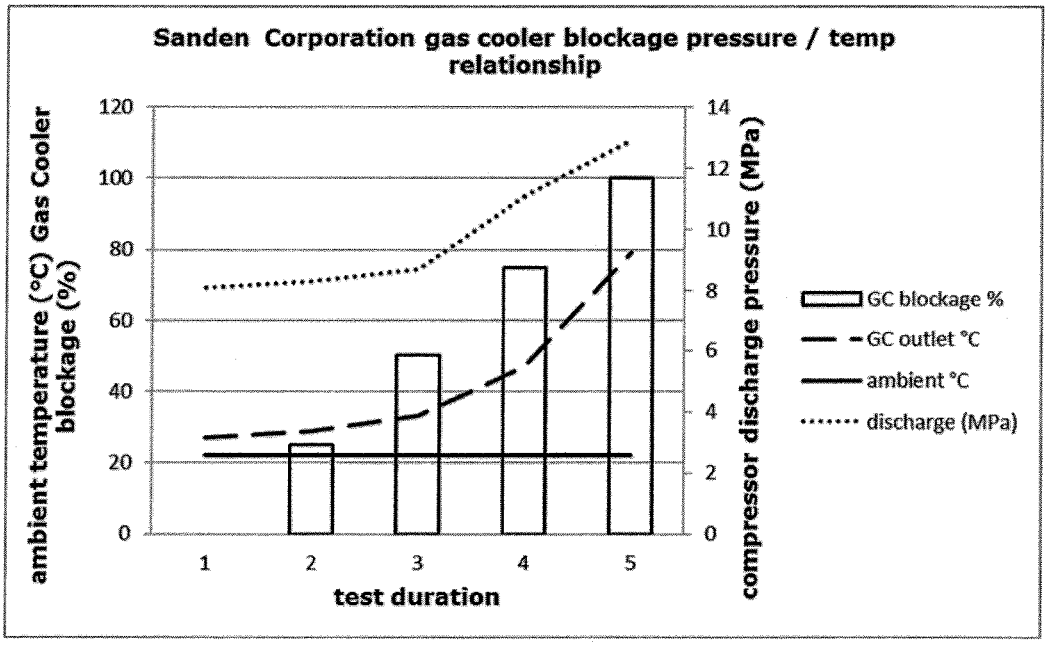

FIG. 5 is a similar graph to FIG. 4, except that a Sanden Corporation™ gas cooler is used, together with a 0.28 Kg charge of $CO_2$. The graph shows that the relationship holds true for different types of gas coolers.

Figure 6:
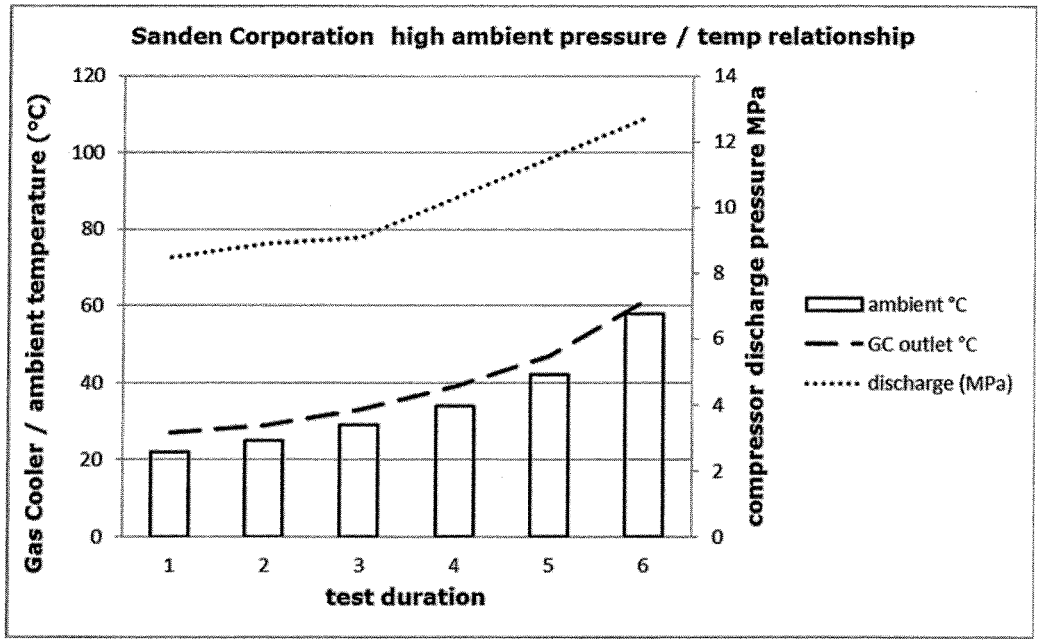
FIGS. 6 and 7 are graphs showing the relationship between pressure and the output temperature of a gas cooler, with varying ambient temperature.
Figure 7:
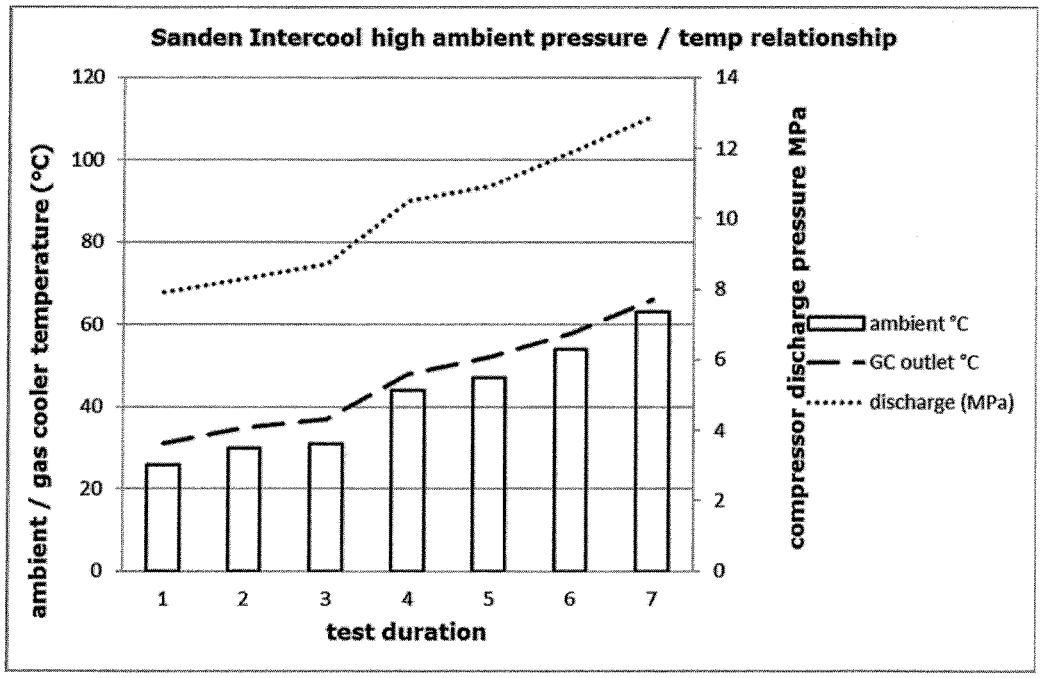

FIGS. 6 and 7 show that the temperature-pressure relationship holds for the Sanden Intercool and Sanden Corporation gas coolers, respectively, when the ambient temperature varies.

The inventors have also found that the relationship between pressure and the output temperature of a gas cooler holds true, with varying ambient temperature, with a fixed amount of gas cooler blockage, for the Sanden Intercool and Sanden Corporation gas coolers.

Thus the inventors have discovered that measuring the gas cooler output temperature $T_{GC}$ in the present invention can be used to indicate the pressure in the refrigeration system 1 in a reliable manner.

The microcontroller 15 uses the signals received from the temperature sensor 17, which are indicative of the output temperature of the gas cooler $T_{GC}$, to determine when to switch the compressor 3 on/off in order to maintain the pressure within the refrigeration system 1 within normal operating conditions, in a manner that prevents the compressor 3 from oscillating the refrigeration system 1. The microprocessor 15 is programmed with an upper temperature value $T_U$ and an offset temperature value X. A lower temperature value $T_L$ is determined by calculating $T_U$–X. Typically the value used for $T_U$ is in the range 40° C. to 60° C. Typically the value for X is in the range 3° C. to 30° C. For example, $T_U$ may be set at 50° C. and X may be set at 10° C. Of course it will be appreciated by skilled person that the values for the upper threshold temperature value $T_U$ and the offset temperature value X will depend on the specific application. An OEM manufacturer can determine the values according to its needs.

The microprocessor 15 may be arranged such that at least one of $T_U$ and X is fixed (i.e. cannot be changed by the user after the microprocessor has been programmed). The microprocessor 15 may be arranged such that at least one of Tu and X is programmable by a user, for example via a user interface.

Figure 8:
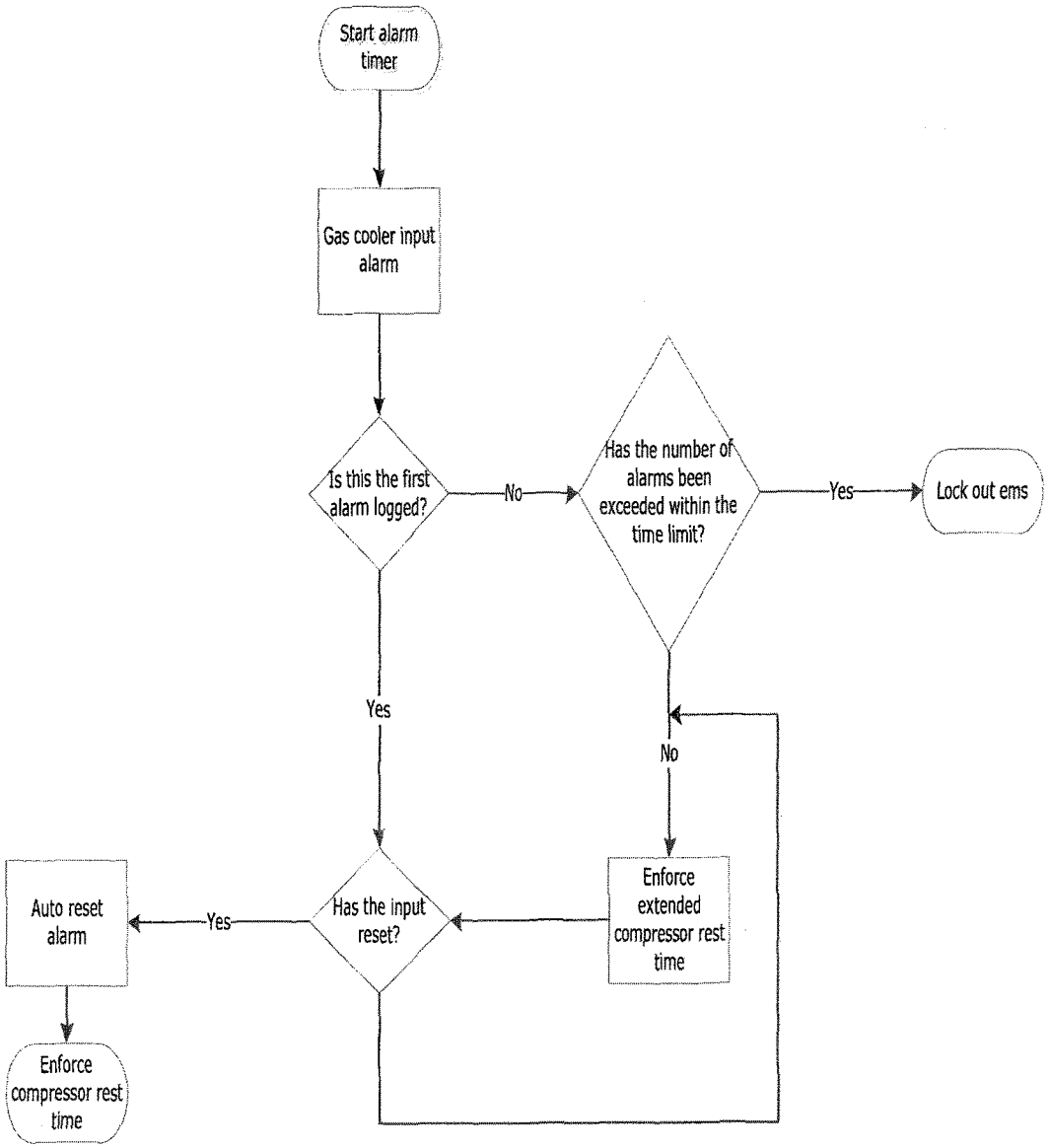
FIG. 8 is a flow diagram of a digital gas cooler alarm process for a programmable microcontroller, that is used to control operation of the first embodiment of the invention.
Figure 9:
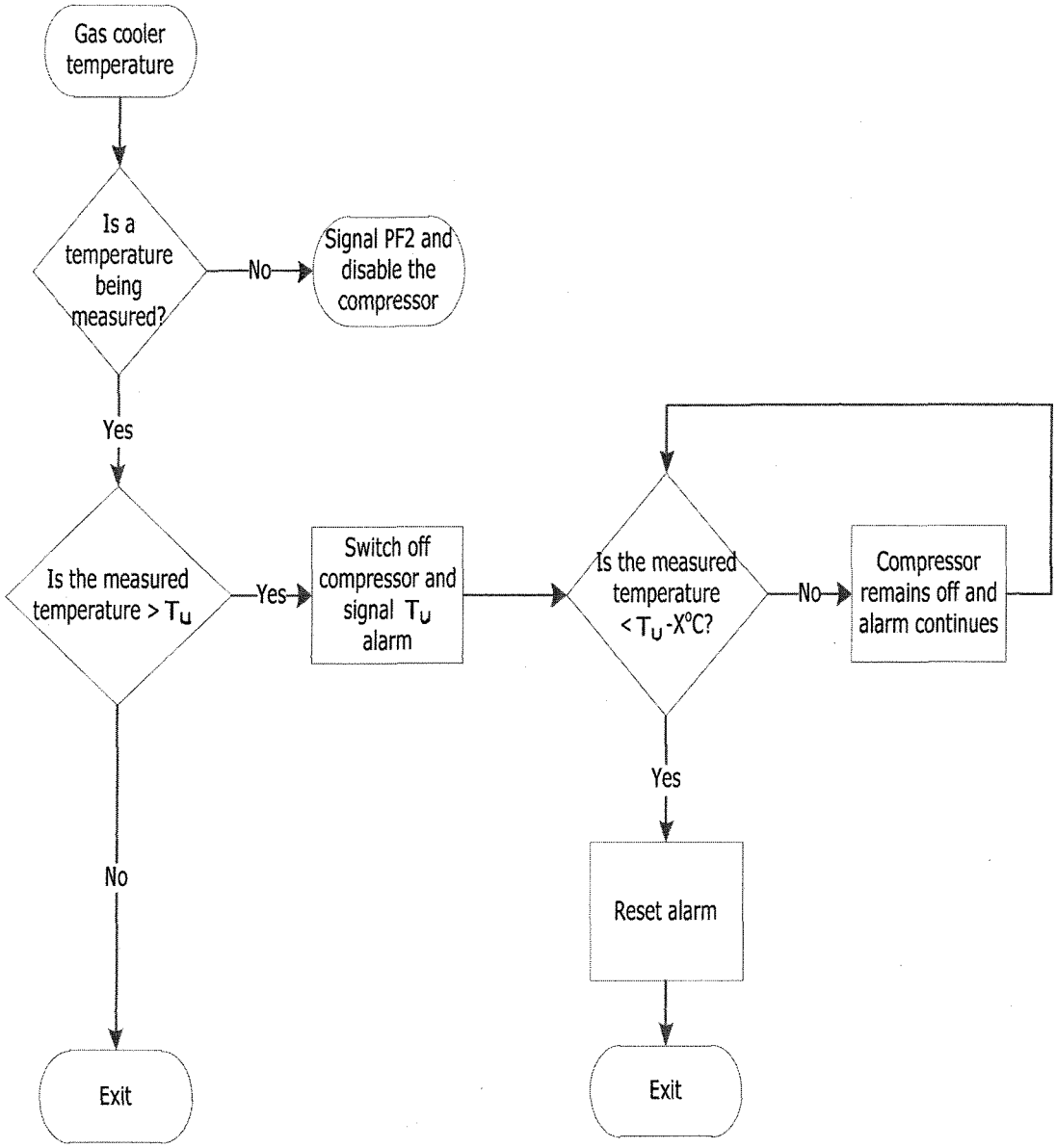
FIG. 9 is a flow diagram of an analogue gas cooler alarm process for the programmable microcontroller, that is used to control operation of the first embodiment of the invention.
Figure 10:
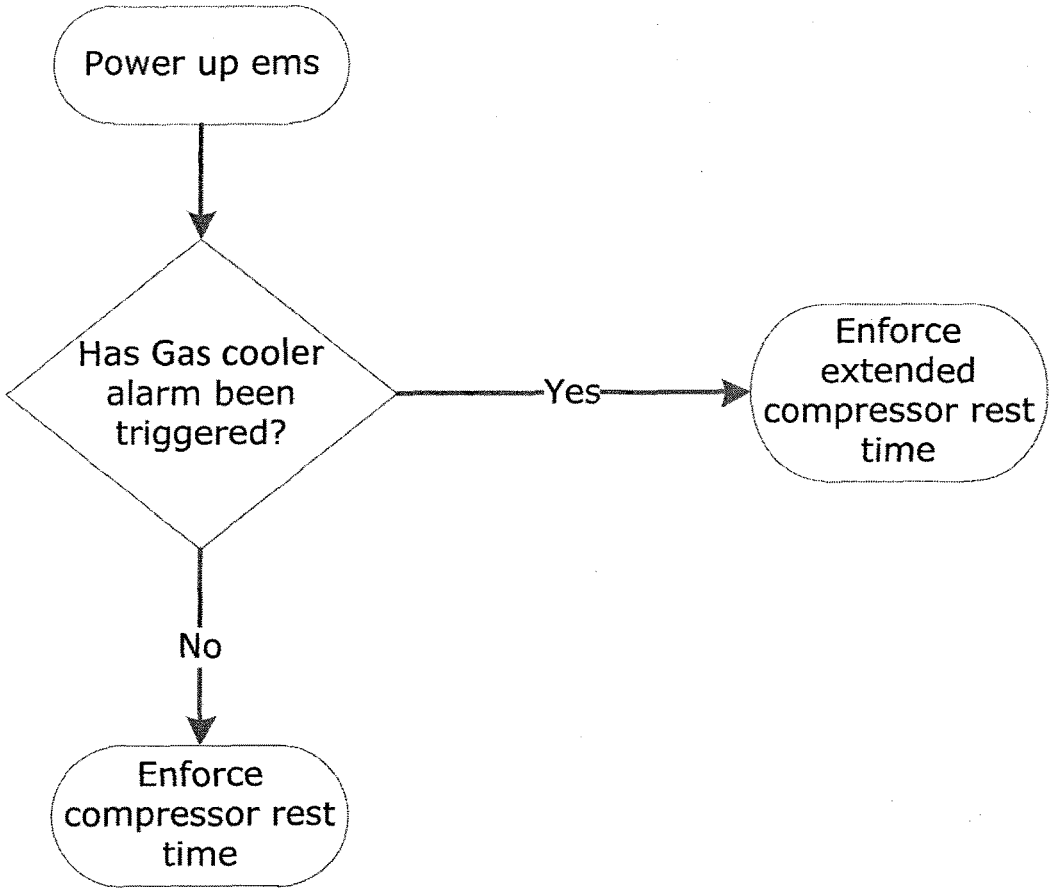
FIG. 10 is a flow diagram of a compressor reset time process.

The control logic for the microprocessor 15 is shown in the flow diagrams in FIGS. 8 to 10. As a safety check, the microprocessor 15 initially determines if it is receiving signals from the temperature sensor 17. If not, then the compressor 3 is shut down (see FIG. 9).

When the temperature sensor 17 is operating correctly, the microprocessor 15 determines from the signals received from the temperature sensor 17 whether the output temperature of the gas cooler $T_{GC}$ is greater than or equal to the upper temperature value $T_U$, by comparing $T_{GC}$ with the stored value for $T_U$. When $T_{GC}$ is greater than or equal to $T_U$ the microprocessor 15 determines that the pressure within the refrigeration system 1 is at its maximum acceptable value and the microprocessor 15 cuts power to the compressor 3 by opening switch 1 (see FIG. 3), and signals a $T_U$ alarm (see FIG. 9). When the compressor 3 is switched off, the pressure within the refrigeration system 1, and hence the output temperature of the gas cooler $T_{GC}$, begins to fall. Thus, there is a period during which the compressor 3 is switched off.

When the microprocessor 15 determines from the signals received from the temperature sensor 17 that the output temperature of the gas cooler $T_{GC}$ has cooled by X° C. to a temperature that is less than or equal to the lower temperature value $T_L$, the microprocessor 15 resets the alarm and then initiates an extended rest time Y for the compressor 3 (see FIG. 8), for example monitored by reference to its internal clock, before switching the compressor 3 back on again. Thus, the microprocessor 15 is programmed to apply the extended rest time Y, in addition to the variable period of time that it takes $T_{GC}$ to cool by X° C., in order to delay the operation of the compressor 3. The extended rest time Y is preferably fixed for the system. Typically Y is in the range 1 to 20 minutes although Y may be selected to suit the particular refrigeration system.

The inventors have found that by delaying operation of the compressor 3 by the extended rest time Y, the system is prevented from oscillating since more time is provided to enable system pressures to equalise.

If the number of gas cooler alarms exceeds a predetermined value within a predetermined time period, then the microprocessor 15 is programmed to shut down the refrigeration system 1 and to issue an error signal.

Optionally, the refrigeration system 1 may include a pressure relief switch 31 located in the live input line 35 to the compressor 3 (see FIG. 3). Pressure relief switches are known in the art and any suitable conventional switch may be used.

The pressure relief switch 31 may be connected to the microprocessor 15, for example an auxiliary input thereof, and the microprocessor 15 may be arranged to monitor the operational status of the pressure relief switch 31 and to control operation of the compressor 3 according to the signals received form the pressure relief switch.

It will be apparent to the skilled person that modifications may be made to the above embodiment that falls within the scope of the invention. For example, the embodiment may include a bursting disc. In such an embodiment, the pressure in the refrigeration systems 1 may be controlled by the microprocessor 15 in order keep the pressure below the bursting disc rupture pressure, thereby preventing the bursting disc from rupturing and improving the safety of the systems.

The refrigeration systems 1 may include high pressure pipe work, which is designed to withstand the highest pressure that can be generated by the system. This improves the safety of the systems.

The microprocessor may be programmed such that, when the microprocessor is powered up, the compressor rest time must expire before allowing the compressor to restart. The microprocessor may be arranged to apply the extended compressor rest time rather than a standard rest time when the microprocessor is rebooted.

The microprocessor may include a user interface to enable a user to: set parameters—such as the maximum number of alarms, $T_U$, $T_L$, X, Y; cancel alarms; cancel error messages; and invert an input when in digital mode.

The microprocessor may be arranged such that $T_U$ and $T_L$ are programmed, rather than specifying X and calculating $T_L$ on the basis of $T_U$–X. In this instance, $T_L$ is typically in the range 30° C. to 50° C.

It is envisaged that the invention may be applicable to refrigeration systems that use a different refrigerant to $CO_2$.

The invention claimed is:

1. A $CO_2$ refrigeration system, including: a compressor, a gas cooler, a temperature sensor, and an electronic control system, the electronic control system including a processor device arranged to control operation of the compressor according to input signals received from the temperature sensor, wherein:

(a) the temperature sensor is positioned to read an output temperature of the gas cooler, (b) the processor device is arranged to compare the measured temperature of the gas cooler output with a lower threshold temperature value, and (c) in a condition where the processor device determines that the measured temperature is less than or equal to the lower threshold temperature value, the processor device is arranged to initiate an extended rest period for the compressor, and (d) the processor device is arranged to activate the compressor device when the extended rest period has ended.

2. The refrigeration system according to claim 1, wherein the temperature sensor is positioned to measure the temperature of the $CO_2$ refrigerant directly as it exits the gas cooler.

3. The refrigeration system according to claim 1, wherein the temperature sensor is mounted on at least one of a gas cooler wall and an adjacent conduit.

4. The refrigeration system according to claim 1, including an upper threshold temperature value stored in memory in the processor device, wherein the processor device is arranged to compare the measured temperature of the gas cooler output with the upper threshold temperature value and wherein in a condition where the processor device determines that the measured temperature is greater than or equal to the upper threshold temperature value, the processor device is arranged to deactivate the compressor.

5. The refrigeration system according to claim 4, wherein the processor device is arranged to generate a gas cooler alarm signal each time the measured temperature is determined to be greater than or equal to the upper threshold temperature value and wherein the processor device is arranged to shut down the refrigeration system if the number of gas cooler alarms exceeds a predetermined value within a predetermined time period.

6. The refrigeration system according to claim 1, wherein the extended rest period is a fixed time period.

7. The refrigeration system according to claim 6, wherein the extended rest period lasts for at least 5 minutes.

8. The refrigeration system according to claim 6, wherein the extended rest period lasts for at least 8 minutes.

9. The refrigeration system according to claim 6, wherein the extended rest period lasts for at least 10 minutes.

10. The refrigeration system according to claim 1, the system further including a clock and the extended rest period is timed by the clock.

11. The refrigeration system according to claim 1, wherein the lower threshold temperature value is determined by subtracting an offset temperature value from the lower threshold temperature value.

12. The refrigeration system according to claim 11, wherein the offset temperature value is at least 5° C.

13. The refrigeration system according to claim 11, wherein the offset temperature value is at least 8° C.

14. The refrigeration system according to claim 11, wherein the offset temperature value is at least 10° C.

15. The refrigeration system according to claim 11, wherein the offset temperature value is at least 12° C.

16. The refrigeration system according to claim 1, wherein the temperature sensor is connected to an auxiliary input of the processor device.

17. The refrigeration system according to claim 1, the system further including a pressure sensitive device.

18. The refrigeration system according to claim 1, the system further including a rupturing device that is arranged to rupture when the operating pressure within the refrigeration system reaches a rupture pressure, wherein the processor device is arranged to control operation of the compressor to maintain the refrigeration system operating pressure at a value that is less than the rupture pressure.

19. The refrigeration system according to claim 1, wherein the processor device includes an interface that is arranged to enable the user to set at least one of the following parameters: the upper threshold temperature value, the lower threshold temperature value, and the length of the extended rest period for the compressor.

20. A method for controlling a compressor in a $CO_2$ refrigeration system, said $CO_2$ refrigeration system having a compressor, a gas cooler, a temperature sensor and an electronic control system including a processor device, wherein the method comprises:

(a) measuring $CO_2$ refrigerant temperature at the output of the gas cooler with the temperature sensor and using the processor device to control operation of the compressor according to input signals received by the processor device from the temperature sensor;

(b) comparing the measured temperature of the gas cooler output with a lower threshold temperature value stored in memory in the processor device;

(c) automatically initiating an extended rest period for the compressor when the processor device determines that the measured temperature is less than or equal to the lower threshold temperature value; and (d) activating the compressor when the extended rest period has ended.

21. The method according to claim 20, the method further including comparing the measured temperature of the gas cooler output with an upper threshold temperature value stored in a memory means and automatically deactivating the compressor when the processor device determines that the measured temperature is greater than or equal to the upper threshold temperature value.

22. The method according to claim 21, the method further including the processor device generating a gas cooler alarm signal each time the measured temperature is determined to be greater than or equal to the upper threshold temperature value.

23. The method according to claim 22, the method further including the processor device shutting down the refrigeration system if the number of gas cooler alarms exceeds a predetermined value within a predetermined time period.

24. The method according to claim 20, wherein the extended period is a fixed period of time.

25. The method according to claim 24, the wherein the extended rest period lasts for at least 3 minutes.

26. The method according to claim 20, the method further including calculating the lower threshold temperature value by subtracting an offset temperature value from the lower threshold temperature value.

27. The method according to claim 26, wherein the offset temperature value is at least 8° C.

28. The method according to claim 26, wherein the offset temperature value is at least 10° C.

29. The method according to claim 26, wherein the offset temperature value is at least 12° C.

30. The method according to claim 20, wherein the refrigeration system further includes a rupturing device that is arranged to rupture at when the operating pressure within the refrigeration system reaches a rupture pressure, wherein the processor device is arranged to control operation of the compressor to maintain the refrigeration system operating pressure at a value that is less than the rupture pressure.

31. The method according to claim 20, wherein the extended rest period lasts for at least 5 minutes.

32. The method according to claim 20, wherein the extended rest period lasts for at least 8 minutes.

33. The method according to claim 20, wherein the extended rest period lasts for at least 10 minutes.

* * * * *